US008360755B2

(12) United States Patent
Stephan

(10) Patent No.: US 8,360,755 B2
(45) Date of Patent: Jan. 29, 2013

(54) WET-RUNNING PUMP

(75) Inventor: Waldemar Stephan, Dortmund (DE)

(73) Assignee: Pierburg GmbH, Neuss (DE)

( * ) Notice: Subject to any disclaimer, the term of this patent is extended or adjusted under 35 U.S.C. 154(b) by 927 days.

(21) Appl. No.: 11/886,827

(22) PCT Filed: Mar. 31, 2006

(86) PCT No.: PCT/EP2006/061229

§ 371 (c)(1),
(2), (4) Date: Apr. 3, 2009

(87) PCT Pub. No.: WO2006/106081

PCT Pub. Date: Oct. 12, 2006

(65) Prior Publication Data

US 2009/0232675 A1 Sep. 17, 2009

(30) Foreign Application Priority Data

Apr. 2, 2005 (DE) ..... 10 2005 015 213

(51) Int. Cl.
*F04B 17/04* (2006.01)
*H02K 1/12* (2006.01)

(52) U.S. Cl. ..... 417/423.7; 310/254.1; 417/423.12; 417/423.14

(58) Field of Classification Search ..... 310/254.1; 417/423.7, 423.12, 423.14
See application file for complete search history.

(56) References Cited

U.S. PATENT DOCUMENTS

| | | | | |
|---|---|---|---|---|
| 2,782,721 | A * | 2/1957 | White | 417/357 |
| 4,806,080 | A * | 2/1989 | Mizobuchi et al. | 417/353 |
| 5,785,013 | A * | 7/1998 | Sinn et al. | 123/41.44 |
| 2002/0166520 | A1 | 11/2002 | Heim et al. | 123/41.44 |
| 2003/0020353 | A1 | 1/2003 | Lopatinsky et al. | 310/208 |
| 2003/0161745 | A1 | 8/2003 | Kern | 417/423.7 |
| 2004/0084980 | A1 * | 5/2004 | Yamaguchi et al. | 310/81 |

FOREIGN PATENT DOCUMENTS

| | | | |
|---|---|---|---|
| DE | 19646617 | | 5/1998 |
| EP | 0105687 | A1 | 4/1984 |
| EP | 0217197 | | 4/1987 |
| EP | 0877463 | A2 | 11/1998 |
| EP | 1033495 | | 9/2000 |
| JP | 01122337 | A | 5/1989 |
| JP | 08-042483 | | 2/1996 |
| JP | 10173507 | A | 6/1998 |
| JP | 2001-50186 | A | 2/2001 |
| JP | 2004-278539 | A | 10/2004 |
| JP | 036-08318 | B2 | 1/2005 |
| WO | WO2005/011087 | | 2/2005 |

OTHER PUBLICATIONS

Translation of Oyama et al., JP-01-122337 A.*

International Search Report and Written Opinion dated Aug. 23, 2006 based on PCT Application No. PCT/EP2006/061229.

* cited by examiner

*Primary Examiner* — Nimeshkumar Patel

*Assistant Examiner* — Steven Horikoshi

(74) *Attorney, Agent, or Firm* — Norman B. Thot

(57) ABSTRACT

A wet-running pump comprises a rotor which is connected to a pump wheel and which is arranged in a wet area adapted to have a guided fluid passed therethrough. The wet area is separated from a dry area wherein a stator which cooperates with the rotor, is arranged. The wet area is separated from the dry area by a conductor plate, wherein the electric lines thereof form the stator such that the conductor plate simultaneously forms a separating can, thus simplifying the construction and mounting of the wet-running pump.

11 Claims, 2 Drawing Sheets

WET-RUNNING PUMP

BACKGROUND

1. Field of the Disclosure

The disclosure relates to a wet-running pump, particularly a wet-running pump for automobiles to be used e.g. as a cooling-water pump for automobiles.

2. Discussion of the Background Art

A wet-running pump as known e.g. from EP 02 017 197 is electrically driven and comprises a rotor and a stator. The rotor is connected to a pump wheel so that the stator, arranged at a distance to the rotor, can drive the pump wheel by means of the rotor. Between the rotor and the stator, a separating can is arranged, whereby it is safeguarded that the rotor will have the conveyed fluid flowing therearound and will be cooled, while, at the same time, the stator will not get into contact with the fluid to be conveyed. By the provision of the separating can, it is accomplished that a short circuit of the stator windings is avoided.

In a wet-running pump of the above type, it is disadvantageous that the structure is complicated and the mounting process is correspondingly complex.

It is an object of the disclosure to provide a wet-running pump which is of a simplified structure.

SUMMARY

The wet-running pump of the disclosure, which particularly can be a pump for an automobile, comprises a wet area and a dry area. It is provided that the wet area has a fluid flowing therethrough which is conveyed by the wet-running pump, for the purpose of cooling the wet-running pump or individual components of the wet-running pump. Particularly, within the wet area, a rotor is provided which is connected to a pump wheel. The dry area is separated from the wet area so that the dry area can be used to accommodate electrical components, particularly a stator cooperating with the rotor. According to the disclosure, there is provided a conductor plate which at least partially separates the wet area form the dry area. The conductor plate comprises electric lines for connection to the stator and/or for forming the stator. The conductor plate can also comprise control elements. In this manner, it is possible that the conductor plate is used to replace a separating can which otherwise would be required, or is used to form at least a part of the separating can, wherein the separating can also be modified into a disk-shaped or plate-shaped delimiting element. Since the conductor plate and the separating can are provided as one common component or the conductor plate replaces the separating can, the structure and the mounting process of the wet-running pump are simplified. Additionally, the conductor plate can be coated to obtain an improved resistance against the medium.

According to an independent disclosure, the wet-running pump of the disclosure, which is particularly a wet-running pump for automobiles, comprises a rotor which is connected to a pump wheel and cooperates with a stator. Further, there is provided a conductor plate whose electric lines at least partially form the stator. Preferably, the rotor connected to the pump wheel is arranged in a wet area and the stator is arranged in a dry area, with the wet area being separated from the dry area by a delimiting element, e.g. a separating can. In this case, the conductor plate is preferably connected to the delimiting element, i.e. it is attached by bonding on the side of the delimiting element facing towards the dry area, for instance. Due to the fact that the stator is wholly or partially formed by the conductor plate, individual stators can be omitted or be configured in a reduced size so that the structure and the mounting process of the wet-running pump will be simplified.

The delimiting element or the conductor plate is—most preferably via the surface of the delimiting element facing towards the wet area or of the conductor plate—in contact with the conveyed fluid of the wet-running pump so that the conductor plate is cooled by the conveyed fluid. Since the electrical lines of the conductor plate are normally made of a metallic material such as e.g. copper, the electrical lines have a low thermal resistance so that the heat generated in the stator can be dissipated via the cooled electrical lines. Thus, it is avoided that the heat is transmitted only across a thermally insulating air gap, and, as a result, the cooling of the stator is improved.

Preferably, the conductor plate comprises stator windings of the stator, wherein the stator windings of the stator are preferably formed by the electrical lines of the conductor plate. For this purpose, the rotor and the stator are arranged axially to each other relative to an axis of rotation of the pump wheel and the rotor.

The conductor plate is preferably of a multi-layered configuration. Preferably, also said at least one additional layer for forming the multi-layered conductor plate comprises stator windings. In this manner, it is made possible to form a multi-layered conductor plate comprising a plurality of stator windings arranged behind each other. Preferably, the stator of the wet-running pump is fully integrated into the delimiting element or the conductor plate.

According to a particularly preferred embodiment, the separating can, which is normally provided in wet-running pumps, is modified into a conductor plate. The use of a conductor plate as a delimiting element, particularly as a separating can, in a wet-running pump is to represent an independent disclosure.

The conductor plate particularly is an electric plate with printed electric lines thereon; apart from this feature, the conductor plate is preferably made of a semiconductor material or plastic. The conductor plate can be a substrate with electrical lines formed thereon so that the conductor plate substantially is a circuit carrier. For instance, the conductor plate can at least partially be made of ceramics or IMS (insulated metal substrate). Thus, the delimiting element, i.e. the separating can, as well as the stator of the wet-running pump inclusive of the appertaining lines can be manufactured in a particularly simple manner by a process suited for mass production. Further, by the accomplished reduction of components, the expenditure for assembling the wet-running pump of the disclosure is reduced. Particularly, it is the conductor plate which separates the rotor and the stator from each other in a humidity-tight manner.

Preferably, the delimiting element, and particularly the conductor plate, is formed with an opening for taking up a rotational shaft of the pump wheel. Instead of using an opening, it can also be provided that a bearing support for the rotational shaft is connected to the conductor plate, e.g. by bonding. Thus, the conductor plate can be used not only for supplying power to the stator and for cooling the stator but also as a support for the pump wheel. Particularly, the opening for taking up the rotational shaft is closed on the side facing away from the pump wheel, i.e. towards the side which is not subjected to the flow of the conveyed fluid.

BRIEF DESCRIPTION OF THE DRAWINGS

Preferred embodiments of the disclosure will be described in greater detail hereunder with reference to the accompanying drawings.

DETAILED DESCRIPTION OF THE PREFERRED EMBODIMENT

Figure 1:
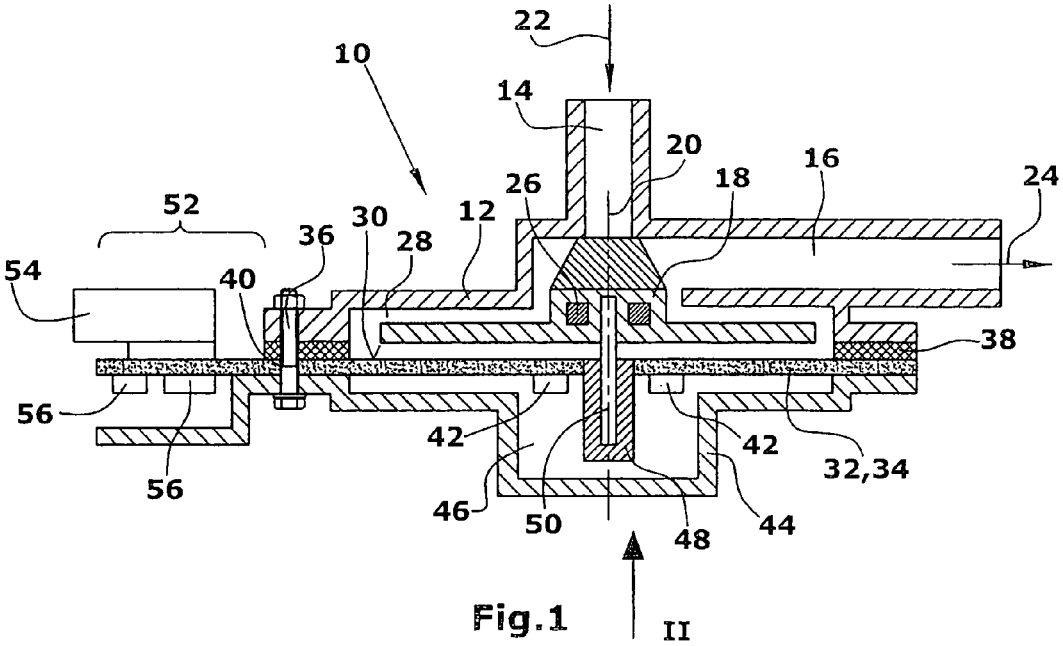
FIG. 1 is a schematic sectional view of a wet-running pump according to the disclosure.

A wet-running pump 10 comprises a pump housing 12 having an inlet 14 and an outlet 16. Between inlet 14 and outlet 16, a pump wheel 18 is arranged. Via inlet 14, pump wheel 18 is subjected to the flow of a to-be-conveyed fluid, notably axially with regard to an axis of rotation 20 of pump wheel 18 in the direction indicated by arrow 22. The fluid is radially conveyed via outlet 16 in the direction indicated by arrow 24. Pump wheel 18 is made of a plastic material with permanent magnets 26 integrated therein to form a rotor. For reasons of clarity, the permanent magnets 26 of the rotor are not shown in a larger scale and are also not shown completely. Pump wheel 18 can also consist of a magnetic plastic.

Pump wheel 18 is arranged in a wet area 28 into which a part of the conveyed fluid can flow. The wet area 28 is delimited on the one hand by the pump housing 12 and on the other hand by a delimiting face 30 of a delimiting element 32 facing toward pump wheel 18. In the illustrated embodiment, the delimiting element 32 consists solely of a conductor plate 34 which by means of a bolt connection 36 is fastened, via a sealing 38, to the pump housing 12. For this purpose, conductor plate 34 is provided with a throughgoing bore 40.

Conductor plate 34 comprises stator windings 42 arranged at axial distances to the permanent magnets 26 of the rotor. For protection from external influences, pump housing 12 is further connected to a pump cover 44 so that a dry area 46 is formed between the delimiting face 30 facing toward the pump wheel, and the pump cover 44. Especially if all of the stator windings 42 are arranged on a possibly multi-layered conductor plate 34, the conductor plate 34 or the delimiting element 32 simultaneously form the pump cover 44, thus on principle obviating the need for a further pump cover 44 in addition to conductor plate 34 or delimiting element 32. Depending on the given case, a further pump cover 44 could be advantageous for reasons of safety, e.g. to prevent damage or contamination of the conductor plate 34 as well as of the electric components of conductor plate 34.

In the illustrated embodiment, conductor plate 34 comprises a bushing 48 configured to take up and support a rotational shaft 50 of pump wheel 18. If required, pump wheel 18 can be additionally held and supported for rotation, respectively, on pump housing 12 also on the side opposite to the side of bushing 48. On the outer side of bushing 48 and/or on the inner side of pump cover 44, further stator windings can be provided, if required. Pump cover 44 and/or pump housing 12 can also be made of a magnetically effective material so to improve the magnetic circuit.

For supplying electric energy to the stator windings 42, conductor plate 34 preferably comprises a connection region 52 arranged externally of pump housing 12 and having arranged therein connection means, e.g. a connector plug 54, for connection to a power source. The connector plug 54 can also be arranged internally of pump housing 12 and internally of pump cover 44; in this case, the electrical contacts of connector plug 54 can be located directly on conductor plate 34, and pump housing 12 or pump cover 44 can form the housing of connector plug 54. Conductor plate 34 can further comprise electric components 56 by means of which the wet-running pump 10 can be controlled and regulated.

Figure 2:
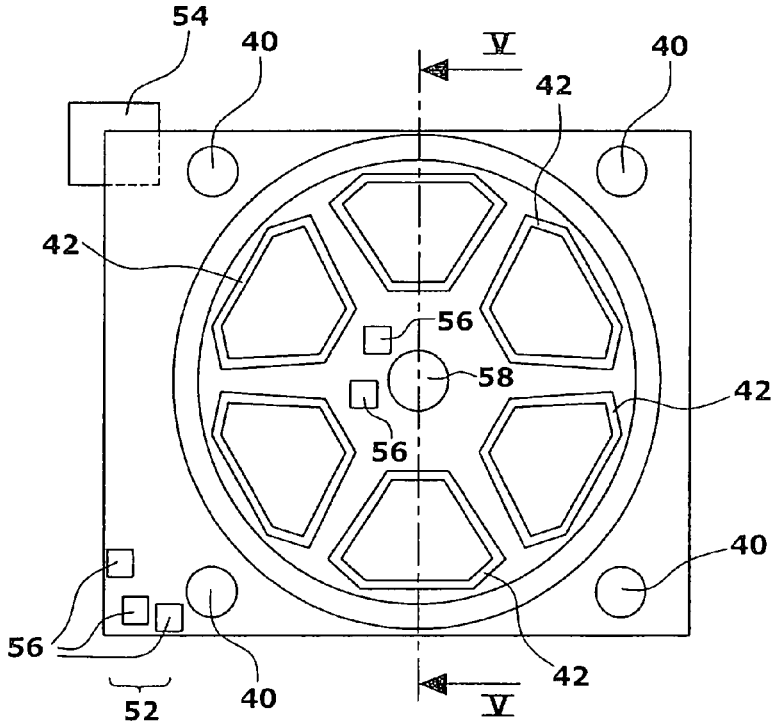
FIG. 2 is a schematic plan view of the wet-running pump as seen in the direction indicated by arrow II in FIG. 1, with the pump cover re-moved.

Conductor plate 34 can be formed with an opening 58 for receiving the rotational shaft 50 (FIG. 2). If required, also bushing 48 or another bearing element is arranged in opening 58.

Figure 3:
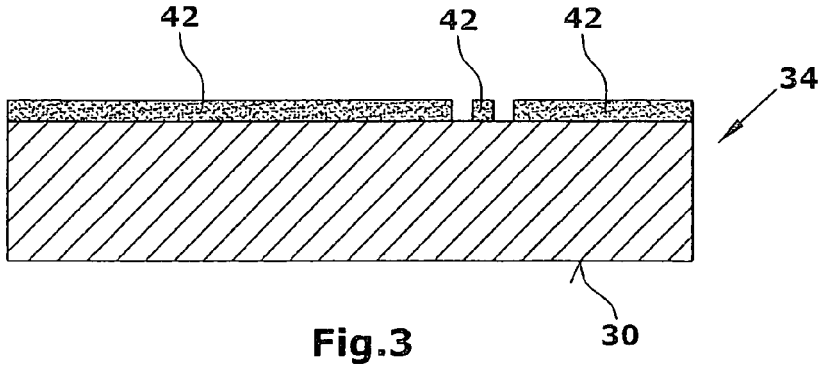
FIG. 3 is a schematic sectional view of a conductor plate according to a first embodiment.

Conductor plate 34 can be provided with printed traces in a manner similar to a conventional electric plate (FIG. 3). Thereby, the stator windings 42 formed by the electrical lines will slightly project from the plate.

Figure 4:
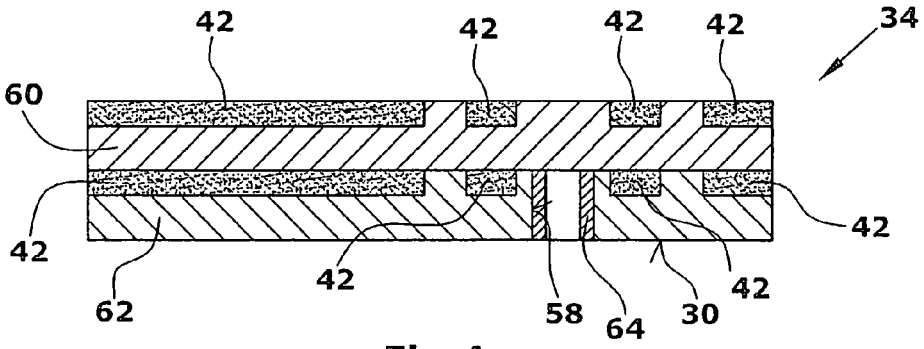
FIG. 4 is a schematic sectional view of a conductor plate according to a second embodiment.

However, the stator windings 42 can also be sunk into the material of the conductor plate 34 (FIG. 4). This makes it possible to easily arrange a plurality of layers 60,62 behind each other wherein, in the illustrated embodiment, the conductor plate 34 consists of a base layer 60 and an additional layer 62. Further, the additional layer 62 has an opening 58 with a bearing sleeve 64 inserted therein for supporting the rotational shaft 50 of pump wheel 18. Due to the multi-layered structure of conductor plate 34, the opening 58 can be closed on the side facing away from pump wheel 18 by the base layer 60.

Figure 5:
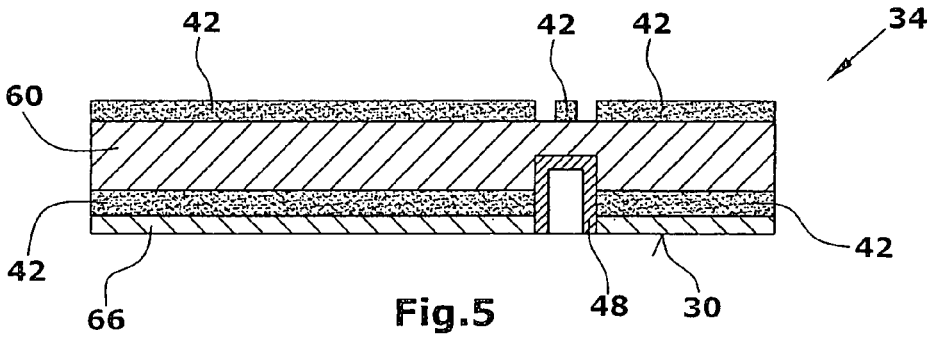
FIG. 5 is a schematic sectional view of a conductor plate according to a third embodiment, as seen in the direction indicated by the line V-V in FIG. 2.

Further, it is possible to provide stator windings 42 on both sides of the base layer 60 of conductor plate 34 (FIG. 5). In this case, the stator windings 42 facing towards the wet region 28 are covered by means of a protective film 66. In such a case, the delimiting face 30 facing towards the wet area and forming the boundary between the wet area 28 and the dry area 46, is formed by the protective film 66.

Figure 6:
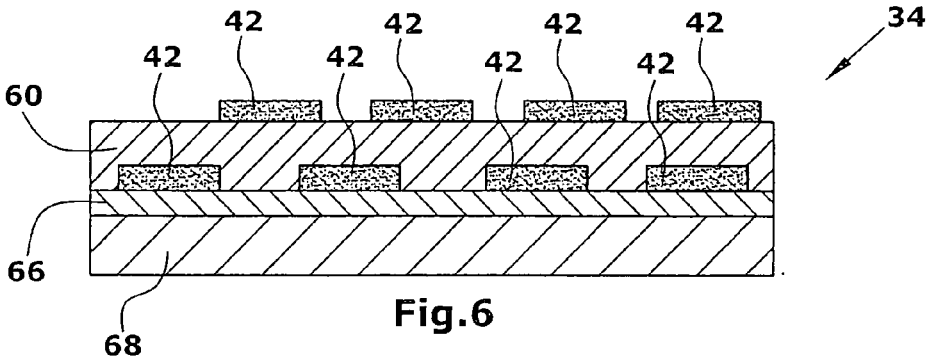
FIG. 6 is a schematic sectional view of a conductor plate according to a fourth embodiment.

A different embodiment (FIG. 6) resides in a conductive plate 34 made of IMS (insulated metal substrate). IMS is preferably provided as an AI plate 68 for use as a substrate whereon the layers 60,62 forming the conductor plate 34 are applied. These layers 60,62 preferably consist of materials similar or identical to those of a commercially available conductor plate.

The invention claimed is:

1. A wet-running pump for conveying a fluid, to be used preferably as a cooling-water pump for an automobile, comprising a wet area adapted to have a fluid passed therethrough and provided for cooling the wet-running pump, a dry area separated from the wet area and provided for arrangement of electrical components therein in a manner allowing for reliable operation of said electrical components, and a printed circuit board provided for at least partial delimitation of the wet area from the dry area, said printed circuit board comprising electric lines for connection to a stator and/or for forming said stator.

2. The wet-running pump according to claim 1, wherein the wet area has a rotor arranged therein which is connected to a pump wheel and cooperates with the stator arranged preferably in the dry area.

3. The wet-running pump according to claim 2, wherein the rotor and the stator are separated from each other in a humidity-tight manner by the printed circuit board.

4. The wet-running pump according to claim 1, wherein the printed circuit board comprises stator windings of the stator which are preferably formed by the electric lines of the printed circuit board.

5. The wet-running pump according to claim 1, wherein the printed circuit board comprises at least one additional layer for forming a multi-layered printed circuit board including a plurality of stator windings which are preferably arranged behind each other.

6. The wet-running pump according to claim 1, wherein the printed circuit board has an opening formed therein for taking up a rotational shaft of the pump wheel.

7. The wet-running pump according to claim 6, wherein the opening is closed on the side facing away from the pump wheel.

8. The wet-running pump according to claim 1, wherein the printed circuit board comprises a stator winding arranged on a side facing towards the wet area, said stator winding being covered by a humidity-tight protective layer, preferably a self-adhesive film.

9. The wet-running pump according to claim 1, wherein the printed circuit board comprises a fastener for mounting to a pump housing and/or a pump cover.

10. The wet-running pump according to claim 1, wherein the printed circuit board comprises a connection region including an electric connector for connection to a power supply, said connection region being arranged externally of a pump housing, on or in an opposite side of the housing as the pump wheel.

11. A method of using a printed circuit board as a delimiting element for delimiting a wet area of a wet-running pump, the method comprising:

providing a wet-running pump comprising:

a wet area adapted to have a fluid passed therethrough and provided for cooling the wet-running pump, a dry area separated from the wet area and provided for arrangement of electrical components therein in a manner allowing for reliable operation of said electrical components, and a printed circuit board provided for at least partial delimitation of the wet area from the dry area, said printed circuit board comprising electric lines for connection to a stator and/or for forming said stator; and using the printed circuit board in the wet-running pump in an automobile as a cooling-water pump.

* * * * *